US007448852B2

(12) United States Patent
Abdelwahab et al.

(10) Patent No.: US 7,448,852 B2
(45) Date of Patent: Nov. 11, 2008

(54) LEANED CENTRIFUGAL COMPRESSOR AIRFOIL DIFFUSER

(75) Inventors: Ahmed Abdelwahab, Tonawanda, NY (US); Robert Leroy Baker, Williamsville, NY (US); Gordon J. Gerber, Boston, NY (US)

(73) Assignee: Praxair Technology, Inc., Danbury, CT (US)

( * ) Notice: Subject to any disclaimer, the term of this patent is extended or adjusted under 35 U.S.C. 154(b) by 499 days.

(21) Appl. No.: 11/199,254

(22) Filed: Aug. 9, 2005

(65) Prior Publication Data

US 2007/0036647 A1 Feb. 15, 2007

(51) Int. Cl.
*F04D 29/44* (2006.01)

(52) U.S. Cl. ..... 415/208.3; 415/211.1; 415/211.2

(58) Field of Classification Search ..... 415/211.1, 415/208.3, 207
See application file for complete search history.

(56) References Cited

U.S. PATENT DOCUMENTS

| | | | | |
|---|---|---|---|---|
| 2,362,514 | A * | 11/1944 | Warner | 415/208.3 |
| 2,372,880 | A | 4/1945 | Browne | |
| 4,798,518 | A * | 1/1989 | Holzberger et al. | 415/208.3 |
| 4,900,225 | A | 2/1990 | Wulf et al. | 415/224.5 |
| 4,978,278 | A | 12/1990 | Kun | 415/144 |
| 4,982,889 | A | 1/1991 | Eardley | 277/27 |
| 5,046,919 | A | 9/1991 | Wulf | 415/1 |
| 5,368,440 | A | 11/1994 | Japikse et al. | 415/208.3 |
| 5,730,580 | A | 3/1998 | Japikse | 415/208.3 |
| 5,901,579 | A | 5/1999 | Mahoney et al. | 62/646 |
| 6,582,185 | B2 | 6/2003 | Lippert et al. | 415/58.4 |

FOREIGN PATENT DOCUMENTS

| | | | |
|---|---|---|---|
| DE | 19502808 | A1 * | 8/1996 |
| JP | 54069811 | A * | 6/1979 |
| JP | 60184999 | A * | 9/1985 |
| JP | 63198798 | A * | 8/1988 |
| SU | 01339303 | A1 * | 9/1987 |

OTHER PUBLICATIONS

Denton et al., "The Exploitation of Three-Dimensional Flow in Turbomachinery Design", Proceedings of the Institution of Mechanical Engineers, vol. 213, Part C (1999).

* cited by examiner

*Primary Examiner*—Richard Edgar
(74) *Attorney, Agent, or Firm*—David M. Rosenblum

(57) ABSTRACT

A low solidity vaned airfoil diffuser for a centrifugal compressor wherein each blade has a lean angle greater than zero and wherein the hub stagger angle may be the same as or may be different from the shroud stagger angle for each blade.

9 Claims, 5 Drawing Sheets

LEANED CENTRIFUGAL COMPRESSOR AIRFOIL DIFFUSER

TECHNICAL FIELD

This invention relates generally to centrifugal compressors and, more particularly, to centrifugal compressors for use in cryogenic rectification systems such as the cryogenic rectification of air to produce atmospheric gases such as oxygen, nitrogen,and argon.

BACKGROUND ART

A centrifugal compressor employs a wheel or impeller mounted on a rotatable shaft positioned within a stationary housing. The wheel defines a gas flow path from the entrance to the exit. Low solidity airfoil diffusers have been used successfully as efficient and compact dynamic pressure recovery devices in industrial centrifugal compressor stages. Typically such diffusers have a cascade of two-dimensional airfoil blades or vanes distributed circumferentially at close proximity to the impeller exit. The fundamental characteristic of this type of diffuser is the lack of a geometrical throat that permits it to increase the operating range without the risk of flow choking. This type of diffuser geometry has a large flow range close to that of vaneless diffusers while achieving pressure recovery levels close to that of channel type diffusers. Recently however, due to increased competitiveness in the process industry, centrifugal compressor operating ranges are being challenged to increase beyond the existing ranges of the present two-dimensional diffuser configurations.

SUMMARY OF THE INVENTION

One aspect of the invention is:

An airfoil diffuser with a plurality of diffuser blades for a centrifugal compressor having an impeller wherein the ratio of the distance between a diffuser blade leading edge and trailing edge to the distance between any two consecutive blades is less than one, the diffuser blade lean angle for each blade is greater than zero degrees, and the hub stagger angle is the same as the shroud stagger angle for each blade.

Another aspect of the invention is:

An airfoil diffuser with a plurality of diffuser blades for a centrifugal compressor having an impeller wherein the ratio of the distance between a diffuser blade leading edge and trailing edge to the distance between any two consecutive blades is less than one, the diffuser blade lean angle for each blade is greater than zero degrees, and the hub stagger angle is different from the shroud stagger angle for each blade.

As used herein the term "lean angle" means the angle which the blade stacking direction makes with the direction perpendicular to the hub or shroud planes.

As used herein the term "stagger angle" means the angle which the line connecting the blade leading edge and trailing edge makes with the radial direction.

As used herein the term "hub stagger angle" means the stagger angle where the blade meets the hub of the impeller.

As used herein the term "shroud stagger angle" means the stagger angle at the plane where the blade is adjacent the shroud.

Figure 1:
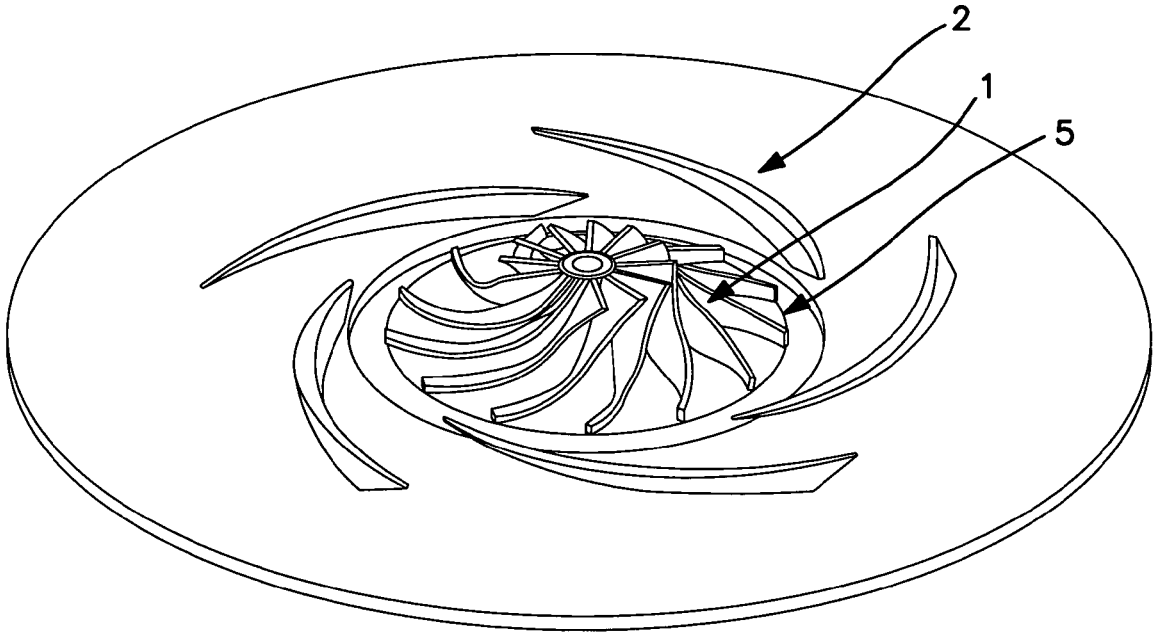
FIG. 1 is a representation of a centrifugal compressor with the diffuser of this invention.

The numerals in the Drawings are the same for the common elements.

DETAILED DESCRIPTION

In general the invention comprises an improved low solidity airfoil diffuser for a centrifugal compressor where each blade has a lean angle greater than zero. The diffuser may be of the variable stagger type, also known as a twisted diffuser, wherein the hub stagger angle is different from the shroud stagger angle for each blade, or may be of the pure lean type where the hub stagger angle is the same as the shroud stagger angle for each blade.

Figure 2:
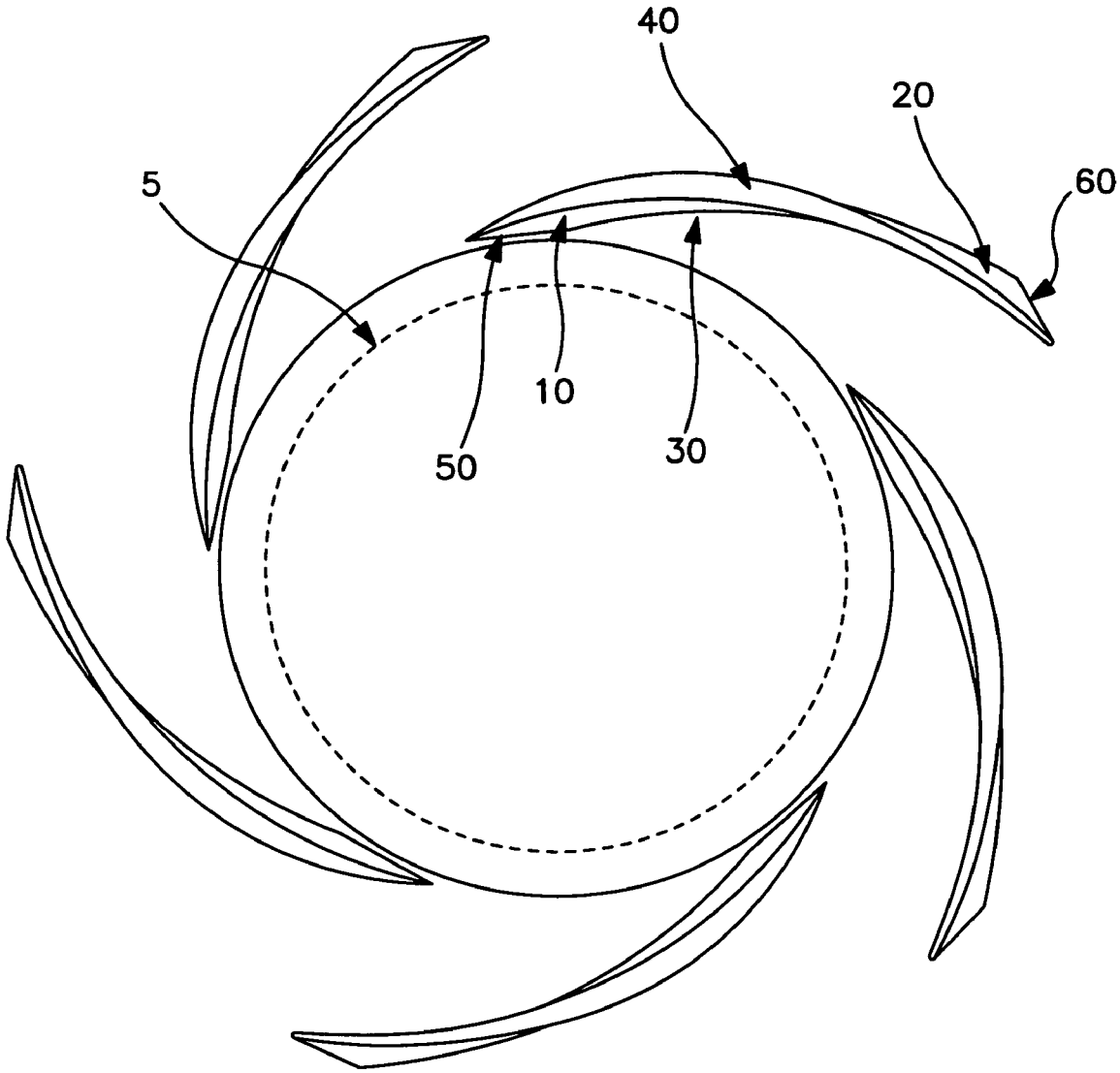
FIG. 2 is a view of one embodiment of the twisted diffuser aspect of this invention.
Figure 3:
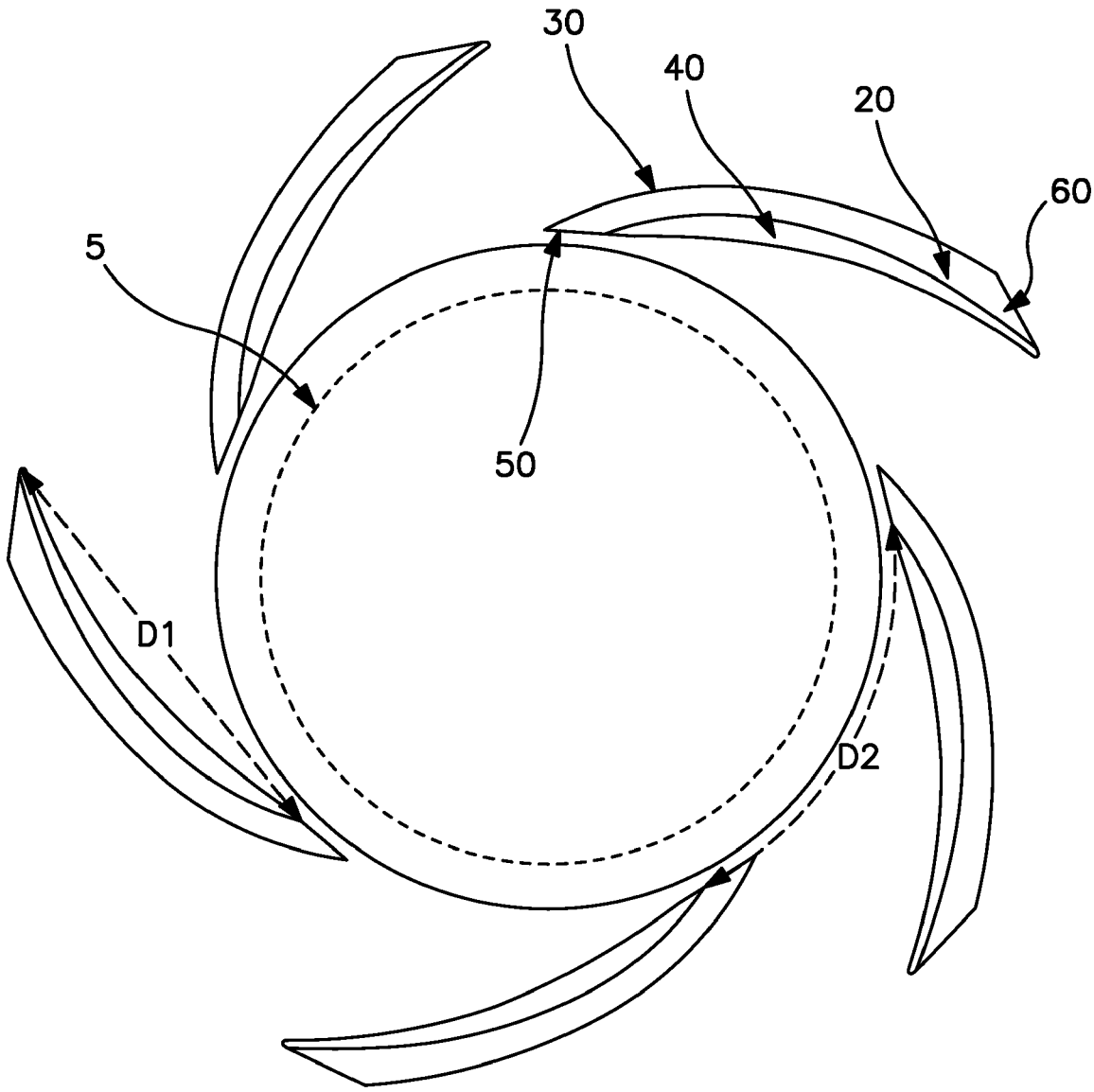
FIG. 3 is a view of one embodiment of the pure lean diffuser aspect of this invention.
Figure 4:
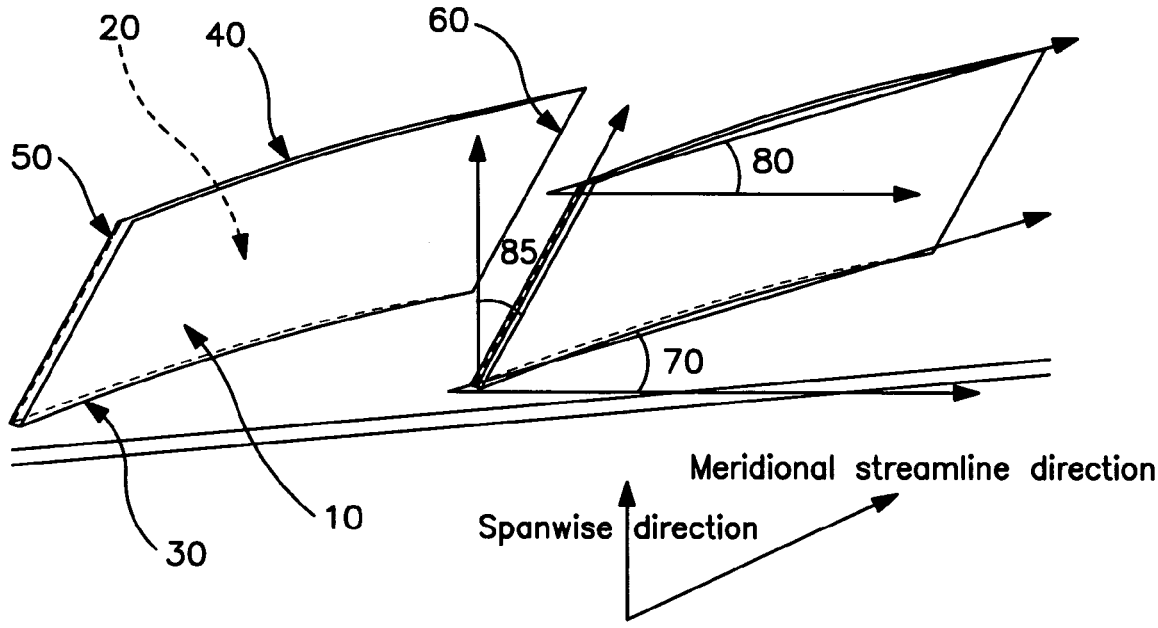
FIG. 4 is a more detailed view of diffuser blades showing the lean angle, the hub stagger angle and the shroud stagger angle.

The invention will be described in greater detail with reference to the Drawings. FIG. 1 shows a centrifugal compressor impeller 1 with a diffuser 2, which may be a variable stagger diffuser as shown in FIG. 2 or a pure lean diffuser as shown in FIG. 3, with a more detailed view of the diffuser blade lean and twist shown in FIG. 4. In the Drawings 5 identifies the impeller outer diameter, 10 is the diffuser blade pressure surface, 20 is the diffuser blade suction surface, 30 is the diffuser blade hub, 40 is the diffuser blade shroud, 50 is the diffuser blade leading edge, 60 is the diffuser blade trailing edge, 70 is the diffuser blade stagger angle at the hub, 80 is the diffuser blade stagger angle at the shroud, and 85 is the diffuser blade lean angle. The diffuser blade is said to have lean when the angle 85 is not equal to zero. The diffuser is said to have variable stagger when the hub stagger angle 80 is not equal to the shroud stagger angle 70. The diffuser blade solidity is defined as the ratio between the distance between the diffuser blade leading and trailing edge (Distance D1 shown in FIG. 3) and the distance between any two consecutive blades (Distance D2 shown in FIG. 3). Low-solidity-airfoil diffusers are diffusers with solidity less than one.

The flow leaving a centrifugal compressor impeller develops a low-velocity wake region at the impeller exit near the shroud suction surface. This low-velocity region is due to secondary flows driven by the meridional and blade-to-blade streamline curvatures as well as Coriolis forces in the tangential direction. This velocity profile results in steeper flow angles near the shroud which not only introduces flow incidence on the diffuser shroud blade but also decreases the boundary layer stability on the shroud wall. The present invention uses the aerodynamic stacking of the diffuser blades to alleviate these flow phenomena that reduce the operating range and efficiency of the entire compressor stage.

Figure 5:
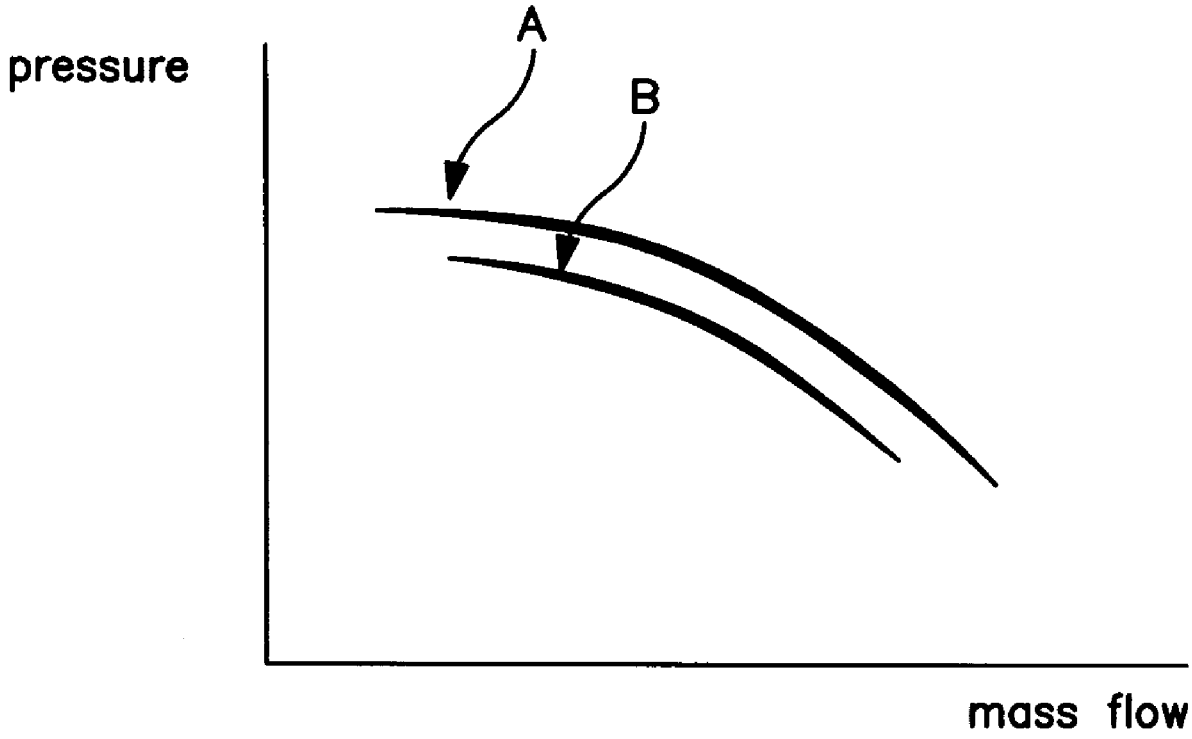
FIG. 5 is a graphical representation showing results obtained with the practice of this invention and comparative results obtained with conventional practice.

In the low solidity airfoil variable stagger (twisted) diffuser aspect of the invention where the diffuser blades are staggered at variable angles from hub to shroud, the variable stagger-angle diffuser blades are designed to better align with the flow direction across the entire flow passage. Furthermore, stacking the diffuser blades at variable stagger angles automatically results in the introduction of blade lean in the diffuser spanwise direction. In the pure leaned diffuser aspect of the invention, the diffuser blades are stacked at an angle to the core diffuser flow (lean angle) without changing the diffuser blades stagger. This simple geometry pure lean diffuser has similar extended operating range as the more complicated geometry variable stagger diffuser at reduced manufacturing cost. The present invention therefore presents an improvement over variable stagger diffuser stacking by using pure lean in stacking the blades. FIG. 5 shows a comparison of the operating map of three impeller-diffuser arrangements in terms of the mass flow rate and the pressure. The variable stagger diffuser and the pure lean diffuser of this invention (Curve A) exhibit wider operating range than the conventional two-dimensional low solidity airfoil diffuser (Curve B) both on the surge and choke flow sides. The variable stagger and the pure leaned diffuser arrangements of this invention increase the operating range of the compressor stage by the same extent over the conventional diffuser on the choke side as well as on the surge side.

The effects of blade lean on blade pressure loading can be very powerful. Blade lean has an effect on the meridional streamline shifting (i.e. passage reaction) and the radial blade pressure loading distribution. The pressure generally increases from the suction surface to the pressure surface. For a leaned blade the inclined blade geometry in the spanwise direction generates a pressure gradient perpendicular to the shroud and hub walls, i.e. spanwise direction. This pressure gradient has the effect of both shifting the meridional streamlines and modifying the loading distribution of the conventional two dimensional cascade blade from hub to shroud. This redistribution of the blade pressure loading and shifting of meridional streamlines can be utilized to redirect the high momentum fluid to energize the low momentum flow region near the shroud wall improving the boundary layer stability on the shroud wall and suppressing secondary flows, hence delaying stall and separation.

The three-dimensional variable stagger and pure leaned low solidity airfoil diffusers of this invention are aerodynamically superior to the conventional two-dimensional diffuser. Furthermore, the pure leaned diffuser has the same effect as a variable stagger (twisted) diffuser in terms of extending the operating range of the compressor stage with the advantage of reduced manufacturing cost. The variable stagger three-dimensional diffuser geometry has the effect of changing the diffuser inlet angle as well as introducing lean in the spanwise direction of the diffuser blade. The change of the inlet angle better aligns the diffuser blades with the incoming flow and the generated lean redistributes the blade pressure loading in the spanwise direction as well as shifts the meridional streamlines towards the diffuser shroud. The pure lean in the diffuser blade has the effect of redistributing the blade pressure loading in the spanwise direction as well as shifting the meridional streamlines towards the diffuser shroud energizing its low momentum flow and preventing its separation over the shroud wall. The overall result of the blade loading redistribution and shifting of the meriodional streamlines due to diffuser blade lean is the increase in compressor operating range and efficiency. The blade lean has stronger contribution in improving its performance and range over the re-alignment of the diffuser blade with the incoming flow. Thus the pure leaned diffuser and the variable stagger diffuser blades have a similar operating range. Therefore, pure blade lean may be used as a means to increase the compressor range and efficiency rather than the more complicated geometry of variable stagger diffuser blade stacking.

Increasing the range and efficiency of the compressor stage allows the compressor to meet the demands of the process cycles that may vary over the lifetime of a plant, such as a cryogenic air separation plant, due to demand or other requirements. This reduces the cost of installing variable speed controls, inlet guide vanes, or redesigning the compressor stage to meet the different process cycles. Furthermore, the improvement in compressor stage efficiency represents an improvement in the operating cost of the compressor.

This invention can be used in any centrifugal compressor stage. The diffuser blade lean can be constant from the hub to shroud or compound varying along the blade span (bow diffuser blade). The stagger angle of the diffuser blade can vary linearly from hub to shroud distributing the blade twist linearly across the blade span or at a nonlinear rate concentrating the blade twist near the hub or shroud. Applicable range of lean angles are from 5 and 60 degrees, twisted diffuser angles are between 5 and 50 degrees, diffuser leading edge diameter ranges are from 4 up to 55 inches, and diffuser blade stagger angles are between 13 and 30 degrees. The diffuser blade airfoil geometry can be a NACA airfoil type or any special geometry airfoil, e.g. supercritical airfoil geometry. This invention can be used with all suitable gases such as air, nitrogen, oxygen, carbon dioxide, helium and hydrogen at any suitable operating pressure and at any suitable impeller tip speed. It applies to all flow and pressure ranges (all specific speeds) typical of centrifugal compressors. Most preferably the diffuser blade is positioned downstream of the impeller at a radius of no less than 10 percent greater than the impeller exit radius.

Although the invention has been described in detail with reference to certain preferred embodiments, those skilled in the art will recognize that there are other embodiments within the spirit and the scope of the claims.

The invention claimed is:

1. An airfoil diffuser with a plurality of diffuser blades for a centrifugal compressor having an impeller wherein the ratio of the distance between a diffuser blade leading edge and trailing edge to the distance between any two consecutive blades is less than one, the diffuser blade lean angle for each blade is greater than zero degrees, and the hub stagger angle is the same as the shroud stagger angle for each blade.

2. The diffuser of claim 1 wherein the lean angle is within the range of from 5 to 60 degrees.

3. The diffuser of claim 1 wherein the hub stagger angle and the shroud stagger angle are both within the range of from 13 to 30 degrees.

4. The diffuser of claim 1 employed with a centrifugal compressor for use in a cryogenic air separation plant.

5. An airfoil diffuser with a plurality of diffuser blades for a centrifugal compressor having an impeller wherein the ratio of the distance between a diffuser blade leading edge and trailing edge to the distance between any two consecutive blades is less than one, the diffuser blade lean angle for each blade is greater than zero degrees, and the hub stagger angle is different from the shroud stagger angle for each blade.

6. The diffuser of claim 5 wherein the lean angle is within the range of from 5 to 60 degrees.

7. The diffuser of claim 5 wherein the hub stagger angle and the shroud stagger angle are both within the range of from 13 to 30 degrees.

8. The diffuser of claim 5 wherein each blade has a twist angle within the range of from 5 to 50 degrees.

9. The diffuser of claim 5 employed with a centrifugal compressor for use in a cryogenic air separation plant.

* * * * *